United States Patent [19]

Murayama et al.

[11] Patent Number: 5,034,655

[45] Date of Patent: Jul. 23, 1991

[54] CIRCULAR FLUORESCENT LAMP

[75] Inventors: Seiichi Murayama, Kokubunji; Hiromitsu Matsuno, Hachioji; Tetsuo Ono, Kokubunji; Yasusuke Seki, Tokyo; Atsuo Koyama, Nagareyama; Churyo Kodama, Tokyo; Tsuyoshi Kobayashi, Funabashi, all of Japan

[73] Assignee: Hitachi, Ltd., Tokyo, Japan

[21] Appl. No.: 397,856

[22] Filed: Aug. 24, 1989

[30] Foreign Application Priority Data

Aug. 26, 1988 [JP] Japan ..... 63-210769

[51] Int. Cl.[5] ..... H01T 63/02

[52] U.S. Cl. ..... 313/493; 313/1

[58] Field of Search ..... 313/1, 493, 634; 220/2.1 R; 439/227-229; 362/216, 260

[56] References Cited

U.S. PATENT DOCUMENTS

| | | | |
|---|---|---|---|
| 2,043,316 | 5/1936 | Johnson | 313/634 X |
| 2,309,676 | 2/1943 | Schmidling | 313/493 X |
| 2,446,712 | 8/1948 | McIlvaine | 313/634 X |
| 2,501,376 | 3/1950 | Breadner et al. | 313/493 X |
| 2,743,388 | 4/1956 | Bartley | 313/634 X |
| 4,833,574 | 5/1989 | Gallagher | 313/493 X |

FOREIGN PATENT DOCUMENTS 60225346 9/1985 Japan .

*Primary Examiner*—Donald J. Yusko
*Assistant Examiner*—Michael Horabik
*Attorney, Agent, or Firm*—Fay, Sharpe, Beall et al.

[57] ABSTRACT

A fluorescent lamp has at least a pair of electrodes, at least two circular discharge tubes connected to said electrodes and enclosing rare gas and mercury therein, and a phosphor coating provided on an inside wall of each of said discharge tubes, the two circular discharge tubes being arranged coaxially circularly on one and the same plane, the diameter of each of the discharge tubes being selected to have a value within a range of from 5 mm to 25 mm both inclusive, the luminance on surface of each of the discharge tubes being selected to have a value within a range of from $2\times10^4$ Cd/m$^2$ to $6\times10^4$ Cd/m$^2$.

21 Claims, 2 Drawing Sheets

CIRCULAR FLUORESCENT LAMP

BACKGROUND OF THE INVENTION

The present invention relates to a fluorescent lamp for general purpose lighting, and particularly relates to a fluorescent lamp suitable for realization of a compact and plain pendant having a high lumen output which is suitable for a living room, a dining room, or the like.

Conventionally, a pendant to be used in a living room, a dining room, or the like, is configured so that a plurality of circular fluorescent lamps different in size from each other are provided in two or three stages so as to make the lumen output high in order to satisfy a user's requirement for a high lumen output. However, this configuration has a disadvantage in that the fixture is large in size, and there is little freedom in design of the fixture. For example, in the case of using three circular fluorescent lamps, the thickness of the stack of three lamps reaches about 10 cm, so that it has been impossible to make the fixture plain. Accordingly, more compact fluorescent lamps have been required.

As a compact fluorescent lamp, such a U-shaped fluorescent lamp as disclosed in Japanese Patent Unexamined Publication No. 60-225346 has been developed and put into practical use.

The conventional U-shaped fluorescent lamp has an elongated shape, and in the case of a pendant using one U-shaped fluorescent lamp, therefore, there has been a disadvantage that the uniformity in angular distribution of light flux is poor. Further, even if a plurality of lamps are used parallelly, the shape of the fixture becomes inevitably square, and therefore there has been a disadvantage that fine appearance is spoiled unless each side of the square of the fixture is made parallel to a wall surface of a room. In either case, such a U-shaped compact fluorescent lamp has not been suitable for a pendant.

SUMMARY OF THE INVENTION

It is therefore an object of the present invention to eliminate the above disadvantages in the prior art.

It is another object of the present invention to provide a compact, plain, high lumen output pendant which has been impossible in the prior art.

In order to attain the above objects, according to the present invention, a fluorescent discharge tube having at least two coaxially circular discharge paths in one and the same plane is used, and in the fluorescent discharge tube, the diameter of each of two discharge tubes constituting the two discharge paths is selected to have a value within a range of from 5 mm to 25 mm, and the luminance on the surface of each of the discharge tubes is selected to have a value within a range of from $2\times10^4$ Cd/m$^2$ to $6\times10^4$ Cd/m$^2$.

That is, by using the fluorescent discharge tube having at least two coaxially circular discharge paths provided on one and the same plane, the plain and high lumen output fluorescent lamp can be realized. Further, by selecting the tube diameter of each of the two discharge tubes constituting the two discharge paths to have a small value within the range of from 5 mm to 25 mm, the power input per unit length can be increased. Furthermore, by selecting the luminance on the surface of the discharge tubes to by within the range of from $2\times10^4$ Cd/m$^2$ to $6\times10^4$ Cd/m$^2$, a large lumen output can be obtained from a small luminous area. Thus, a plain and high lumen output fluorescent lamp can be realized according to the present invention.

Further, by selecting the gap between the two discharge tubes to have a value within a range of from 3 mm to 15 mm both inclusive, a fluorescent lamp can be realized that is well-balanced and superior in fine appearance. Furthermore, by selecting the discharge maintenance voltage of the discharge tube to have a value within a range of from 80 V to 130 V both inclusive so as to be suitable for an electronic ballast circuit using a semiconductor, a highly efficient and less costly system results.

By selecting the outer circumference of the fluorescent lamp to have a value within a range of from 200 mm to 400 mm both inclusive, the fixture may be made small in size without injuring high-grade impression. Further, by selecting the lamp current flowing into the discharge tube to be a value not larger than 0.8 A, lamp life is extended while maintaining a high output.

By using rare earth phosphor for the phosphor coating formed on the inside wall of the discharge tube, a high-lumen output results without reducing the lumen maintenance.

DESCRIPTION OF THE PREFERRED EMBODIMENTS

Figure 1:
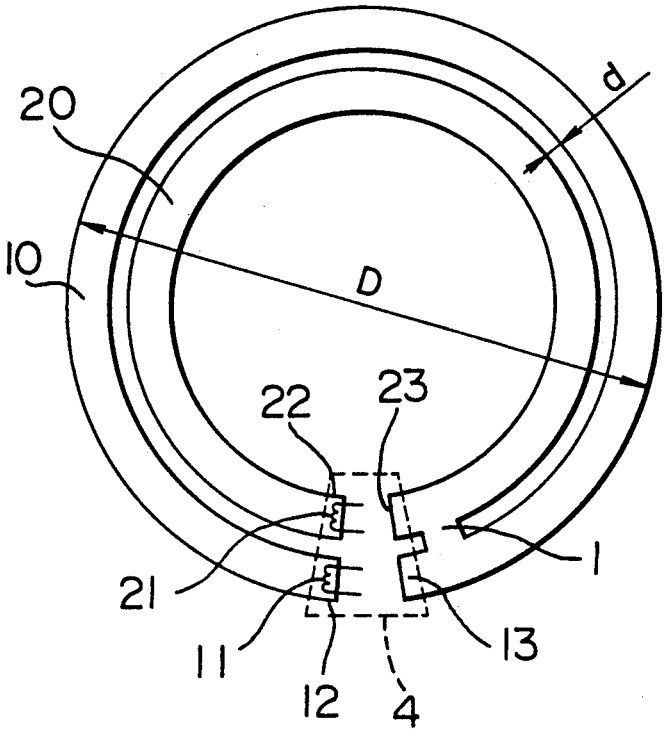
FIG. 1 is a view showing an embodiment of a fluorescent lamp constructed according to the present invention.

Referring to the drawings, embodiments of the fluorescent lamp according to the present invention will be described hereunder.

Figure 2:
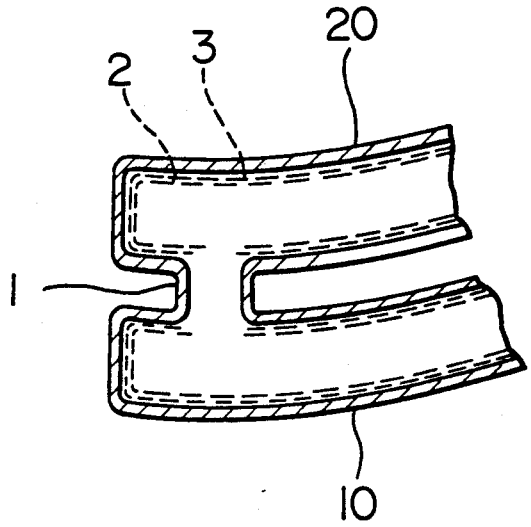
FIG. 2 is an enlarged view of a portion of the embodiment of FIG. 1.

FIG. 1 shows a first embodiment. Two circular discharge tubes 10 and 20 are arranged coaxially circularly on one and the same plane. The discharge tubes 10 and 20 are provided, at their one ends, with electrodes 11 and 21 respectively, and the discharge tubes 10 and 20 are connected, at their other ends 13 and 23, to each other through a bridge 1. FIG. 2 is a cross section showing the vicinity of the bridge 1. The respective discharge spaces of the discharge tubes 10 and 20 communicate with each other through the space of the bridge 1. That is, a discharge path is formed between the electrodes 11 and 21 through the discharge tube 10, the bridge 1, and the discharge tube 20. If the two discharge tubes are connected to each other through the bridge 1 as described above, the discharge path length can be elongated without making the whole of the fluorescent lamp large, resulting in an advantage that the lamp efficiency can be made higher.

It is necessary to select a gap d (mm) between the discharge tubes 10 and 20 to have an average value within a range of from 3 mm to 15 mm both inclusive because, if the average value of the gap d is selected to be smaller than 3 mm, precise manufacturing is required to make the two discharge tubes accurately circular that the manufacturing cost becomes extremely high, while if the average value of the gap d is selected to exceed 15 mm, the two discharge tubes 10 and 20 act as though independent of each other, thus lowering the value of the design. If the average value of the gap d is selected to be within the range of from 3 mm to 10 mm both inclusive, the bridge 1 can be formed in a manner so that a part of the wall glass of each of the discharge tubes 10 and 20 is heated and blown so as to be broken to make a hole, and projected portions formed on the glass tube wall are directly welded to each other. In this method there is an advantage that no additional glass material is required to form the bridge 1.

If the maximum outer radius D of the fluorescent lamp (that is, the outer radius D (mm) of the outermost discharge tube which is the discharge tube 10 in the embodiment) is smaller than 200 mm, a disadvantage occurs in that the rate of space occupation by the electrode portions and the end portions 13 and 23 of the tubes where the luminous efficiency is poor is increased to thereby lower the efficiency of the lamp per se. On the other hand, if the outer radius D exceeds 400 mm, there are disadvantages in that the lighting fixture becomes so large in size as to reduce freedom in design of the fixture, since the lighting fixture can not be practically used in ordinary living rooms or dining rooms. That is, it is optimum to select the maximum outer radius D of the fluorescent lamp to have a value within the above range of from 200 mm to 400 mm both inclusive.

In order to coaxially circularly arrange two or more discharge tubes on one and the same plane with a gap of not larger than 3 mm between the discharge tubes adjacent to each other, precise manufacturing is required to make those discharge tubes accurately circular. If the tube diameter of the discharge tube is selected to exceed 25 mm, a disadvantage occurs in that the glass working for making the discharge tubes accurately circular becomes so difficult that the working cost becomes high. If the tube diameter of the discharge tube is selected to be smaller than 10 mm, there is a disadvantage that the mechanical strength of the glass is so lowered that the handling of the fluorescent lamp is troublesome when the fluorescent lamp is attached to a fixture. Accordingly, it is optimum to select the tube diameter of the discharge tube to have a value within a range of from 10 mm to 25 mm both inclusive. Further, in order to make the fixture more plain, it is preferable to select the diameter of the discharge tube to be not larger than 20 mm.

In order to prevent decrease in lumen output, it is preferable that a thin layer 3 made of a metal oxide such as alumina, silica, cerium oxide, or the like be provided on the inside glass surface of the discharge tube as shown in FIG. 2. A coating of rare earth phosphor 2 is provided on the thin film 3. The bending process of the discharge tube is performed after formation of the phosphor coating. In order to precisely form the discharge tube accurately circular, it is an indispensable condition that the rare earth phosphor to be used be excellent in tolerance to high temperature, because the glass is heated to a temperature higher than that of a conventional circular fluorescent lamp, and because a plurality of discharge tubes to be operated with relatively high wall loading are provided so closely together that the aggregate temperature of the phosphor in the plural tubes becomes considerably high in operation.

A high voltage is required to ignite the discharge tube. However, it is optimum to select the ignition voltage so as not to be higher than 650 V in root mean square value in consideration of the potential use of an inexpensive electrical insulator and of the security for a person working with the discharge tube. Our experiments have proved that the ignition voltage is proportional to the lamp voltage so that the former is five times as high as the latter. Accordingly, the lamp voltage is optionally selected to be no higher than 130 V in root mean square value. If the lamp voltage does not exceed 80 V, there is a disadvantage in that the rate of electrode loss becomes large, so that the efficiency is lowered. That is, it is best to select the lamp voltage to have a value within a range of from 80 V to 130 V both inclusive in root mean square value. A power-source voltage of about 1.5 times as high as the lamp voltage is required to stably maintain the discharge of the fluorescent lamp. Accordingly, the fluorescent lamp having the lamp voltage within the range of from 80 V to 130 V both inclusive can not be directly operated by a 100 V power source of a commercial frequency, and therefore any step-up means is required to operate the fluorescent lamp. If a voltage is boosted by using an ordinary transformer, the lighting operation circuit becomes so large in size that the minimization of the fixture, which is an object of the present invention, is prevented from being attained. Accordingly, the effect of the fluorescent lamp according to the present invention is further increased when the fluorescent lamp is operated by using a small-sized high-frequency electronic ballast circuit or by using a 200V power source of a commercial frequency.

Each of the electrodes 11 and 21 is a heat cathode in which a tungsten coil is coated with an electron emitter mainly containing an oxide of Ba, Sr and Ca. If a lamp current exceeds 0.8 A, there occurs a disadvantage that sputtering of the electron emitter causes the end portions of the tubes to remarkably blacken. In the fluorescent lamp according to the present invention, in which a plurality of discharge tubes are provided coaxially circularly on one and the same plane, and in which the plurality of electrodes are provided close to one another, the blackening in the vicinity of the electrodes makes the external appearance much worse than that in the case of the conventional fluorescent lamp. Accordingly, it is optimum to select the lamp current to be not larger than 0.8 A.

In an example of the embodiment of FIGS. 1 and 2, the tube diameter of each of the discharge tubes 10 and 20 was selected to be 20 mm, the outer radius D of the discharge tube 10 was selected to be 212 mm, the average value of the gap d between the discharge tubes 10 and 20 was selected to be 3 mm, alumina was used as the coating layer 3, a mixture of: $Y_2O_3$; Eu, $MgAl_{11}O_{19}$; Tb, Ce, $3Sr_3(PO_4)_2.CaCl_2$; Eu was used as the rare earth phosphor 2, and argon and mercury were enclosed to provide discharge gas. The fluorescent lamp was electrically and mechanically connected to a lighting fixture through a socket 4 made of resin. The socket 4 was connected to the end portions 12, 22, 13 and 23 of the tubes with so sufficient mechanical strength that the fluorescent lamp was fixed to the fixture mainly through the socket 4. Accordingly, fewer fixing means were required than in the conventional circular fluorescent lamp, providing a more refined fixture design.

When the above fluorescent lamp was operated with a lamp current of 0.6 A by using a high frequency electronic ballast circuit at 30 KHz, the lamp voltage was 107 V, the lamp wattage was 64 W, and the mean luminance was $2.7\times10^4$ $Cdm^{-2}$. The total lumen output of the fluorescent lamp was more, by 10 %, than that in the case where two conventional circular fluorescent lamps of 30 W and 40 W were used, and further the fluorescent lamp according to the present invention could be operated by means of a plain fixture having a thickness of 70 % of that of a fixture using the two conventional circular fluorescent lamps. That is, the fluorescent lamp according to the present invention has an advantage in that it is excellent in efficiency and it can employ a refinedly designed plain lighting fixture, in comparison with the case of using two conventional circular fluorescent lamps.

Figure 3:
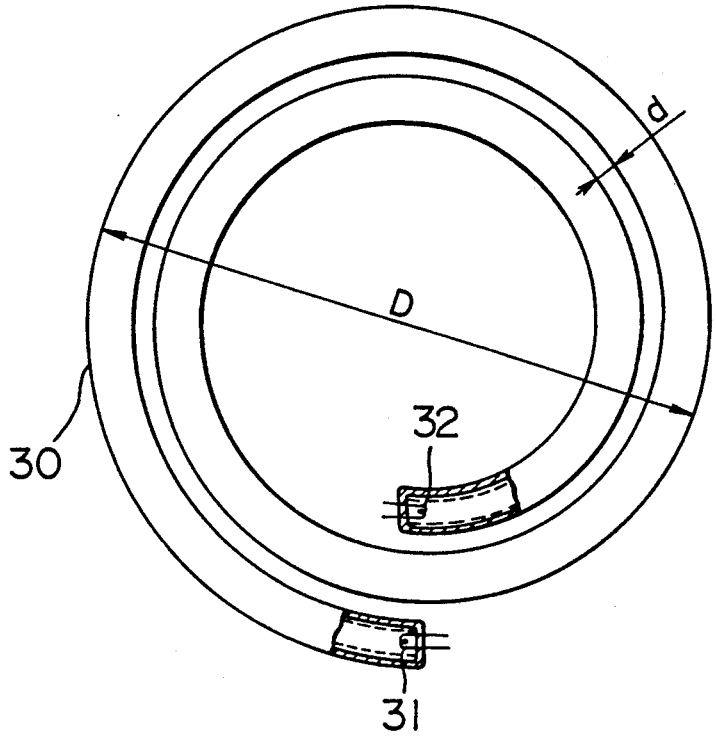
FIGS. 3, 4, and 5 are views showing other embodiments of a fluorescent lamp constructed according to the present invention.

FIG. 3 shows another embodiment of the fluorescent lamp according to the present invention, in which a discharge tube 30 is made spiral and provided with electrodes 31 and 32 at both ends thereof. This embodiment has an advantage that the work for connecting two discharge tubes to each other is not necessary.

Figure 4:
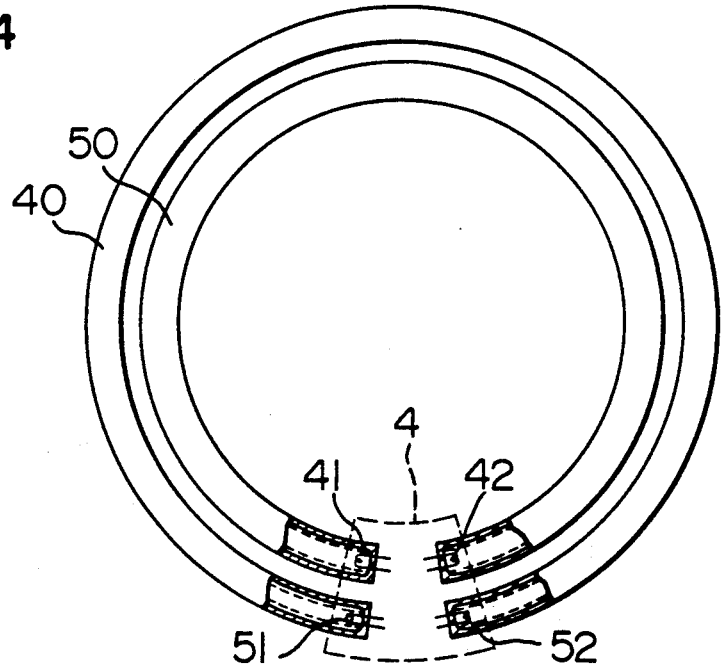

FIG. 4 shows a further embodiment of the fluorescent lamp according to the present invention, in which discharge tubes 40 and 50 each having a pair of electrodes at both ends thereof are coaxially circularly bundled through a socket 4 on one and the same plane. The fluorescent lamp in this embodiment has the advantage that the manufacturing process is simple. It is apparent that each of the discharge tubes 40 and 50 must satisfy the requirements of the present invention that the lamp current is to be not larger than 0.8 A, and the lamp voltage is to be within a range of from 80 V to 130 V both inclusive.

Similarly to the case of a conventional circular fluorescent lamp, it is impossible, also in this embodiment, to carry out a method in which the bases are provided in advance and individually on the discharge tubes 40 and 50 respectively and the discharge tubes 40 and 50 are fixed coaxially circularly through the bases on one and the same plane in a fixture, because the discharge tubes are circular, the tube diameter of each of the discharge tubes has a small value within a range of from 10 mm to 25 mm, and the gap between the discharge tubes has a small value within a range of from 3 mm to 15 mm. That is, in order to make the two discharge tubes coaxially circular on one and the same plane, it is necessary to bundle the two discharge tubes in advance.

In the fluorescent lamp in each of the embodiments illustrated in FIGS. 1 through 4, the wall loading is relatively high, so that in order to make the vapor pressure of mercury optimum, it is preferable to use amalgam such as Bi-In-Hg, In-Hg, or the like.

Figure 5:
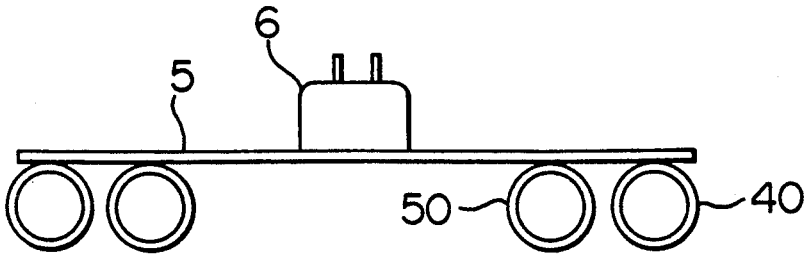

FIG. 5 shows a still further embodiment of the fluorescent lamp according to the present invention. Although FIG. 4 has illustrated the case where the discharge tubes 40 and 50 are bundled through the socket 4, the discharge tubes 40 and 50 are bundled by using a circular plate 5 in this embodiment of FIG. 5. This fluorescent lamp is electrically and mechanically attached to a fixture through a socket 6 attached on the circular plate 5. The discharge tubes 40 and 50 are fixed to the circular plate 5 by means of a silicon binder, a mechanical spring, or the like. If the circular plate 5 is made of a plastic or metal material having good thermal conductivity, there is an advantage that the circular plate 5 serves as a radiator plate, so that optimum mercury vapor pressure can be obtained without using amalgam. Further, if the circular plate 5 is made of a material having a property of reflecting visible light, or is made to reflect visible light by some surface processing, the circular plate 5 may serve also as a visible light reflector.

By the configuration described above in detail, it is possible to realize a fluorescent lamp which is small-sized, plain and well-balanced, and which is excellent in fine appearance, and which has a high lumen output, a high efficiency, and a long life, and it is thereby possible to realize a small-sized and plain pendant which has a high-grade impression and which has a high lumen output.

What is claimed is:

1. A fluorescent lamp, comprising:

first and second circular discharge tubes of different radius, each discharge tube being arranged to enclose a rare gas and mercury, said first and second discharge tubes further being arranged coaxially and circularly in the same radial plane;

a phosphor coating provided on an inside wall of each said discharge tube; and an electrode provided at one end of each said first and second discharge tube, the other ends of each said first and second discharge tube being radially connected by a hollow bridge so that said hollow bridge connects the discharge paths of each said first and second tube to create a single discharge path.

2. A fluorescent lamp as claimed in claim 1, wherein the cross-sectional diameter of each said discharge tube lies between 5 millimeters and 25 millimeters both inclusive, and the luminance on the surface of each said discharge tube lies within the range of $2\times10^4$ Cd/m$^2$ to $6\times10^4$ Cd/m$^2$, both inclusive.

3. A fluorescent lamp according to claim 1, in which a gap d between said two discharge tubes arranged coaxially circularly on one and the same plane is selected to have a value within a range of from 3 mm to 15 mm.

4. A fluorescent lamp according to claim 1, in which a discharge voltage across said pair of electrodes is selected to have a value within a range of from 80 V to 130 V.

5. A fluorescent lamp according to claim 1, in which the maximum outer radius D of said discharge tubes is selected to have a value within a range of from 200 mm to 400 mm.

6. A fluorescent lamp according to claim 2, in which said phosphor is a rare earth phosphor.

7. A fluorescent lamp according to claim 3, in which said phosphor is a rare earth phosphor.

8. A fluorescent lamp according to claim 1, in which the tube diameter of each of said two circular discharge tubes arranged coaxially circularly on one and the same plane is selected to have a value within a range of from 10 mm to 20 mm.

9. A fluorescent lamp according to claim 3, in which the tube diameter of each of said two circular discharge tubes arranged coaxially circularly on one and the same plane is selected to have a value within a range of from 10 mm to 20 mm.

10. A fluorescent lamp according to claim 1, in which a discharge current flowing across said pair of electrodes is selected to have a value not larger than 0.8 A.

11. A fluorescent lamp according to claim 3, in which a discharge current flowing across said pair of electrodes is selected to have a value not larger than 0.8 A.

12. A fluorescent lamp, comprising:

first and second circular discharge tubes of different radius, each discharge tube being arranged to enclose a rare gas and mercury, said first and second discharge tubes further being arranged coaxially and circularly in the same radial plane; and a phosphor coating provided on an inside wall of each said discharge tube, so that the cross-sectional diameter of each said discharge tube lies between 5 millimeters and 25 millimeters both inclusive, and the luminance on the surface of each said discharge tube lies within the range of $2\times10^4$ Cd/m$^2$ to $6\times10^4$ Cd/m$^2$, both inclusive.

13. A fluorescent lamp according to claim 12, in which a gap d between said two discharge tubes arranged coaxially circularly on one and the same plane is selected to have a value within a range of from 3 mm to 15 mm.

14. A fluorescent lamp according to claim 12, in which a discharge voltage across said pair of electrodes is selected to have a value within a range of from 80 V to 130 V.

15. A fluorescent lamp according to claim 12, in which the maximum outer radius D of said discharge tubes is selected to have a value within a range of from 200 mm to 400 mm.

16. A fluorescent lamp according to claim 12, in which said phosphor is a rare earth phosphor.

17. A fluorescent lamp according to claim 13, in which said phosphor is a rare earth phosphor.

18. A fluorescent lamp according to claim 12, in which the tube diameter of each of said two circular discharge tubes arranged coaxially circularly on one and the same plane is selected to have a value within a range of from 10 mm to 20 mm.

19. A fluorescent lamp according to claim 13, in which the tube diameter of each of said two circular discharge tubes arranged coaxially circularly on one and the same plane is selected to have a value within a range of from 10 mm to 20 mm.

20. A fluorescent lamp according to claim 12, in which a discharge current flowing across said pair of electrodes is selected to have a value not larger than 0.8 A.

21. A fluorescent lamp according to claim 13, in which a discharge current flowing across said pair of electrodes is selected to have a value not larger than 0.8 A.

* * * * *